United States Patent [19]

Koch

[11] Patent Number: 4,741,426

[45] Date of Patent: May 3, 1988

[54] COIN ACCEPTOR FOR VENDING MACHINE

[75] Inventor: Frank J. Koch, Ogdensburg, N.Y.

[73] Assignee: DeFelsko Corporation, Ogdensburg, N.Y.

[21] Appl. No.: 938,038

[22] Filed: Dec. 4, 1986

Related U.S. Application Data

[63] Continuation-in-part of Ser. No. 812,506, Dec. 23, 1985, Pat. No. 4,705,153.

[51] Int. Cl.[4] ..... G07D 5/04; G07F 11/04

[52] U.S. Cl. ..... 194/261; 177/51; 194/339

[58] Field of Search ..... 194/261, 339, 277, 225, 194/232, 340; 177/51

[56] References Cited

U.S. PATENT DOCUMENTS

| | | | |
|---|---|---|---|
| 13,840 | 11/1855 | Allender | 177/51 |
| 216,184 | 6/1879 | Hoag | 177/51 |
| 494,653 | 4/1893 | Smith | 194/268 |
| 1,442,941 | 1/1923 | Grover | 194/251 |
| 1,798,172 | 3/1931 | Seitz | 194/229 |
| 2,076,299 | 4/1937 | Kloess | 194/261 |
| 2,256,486 | 9/1941 | Lindberg | 194/294 |
| 2,339,823 | 1/1944 | Vogel | 194/332 |
| 2,370,869 | 3/1945 | McKay | 194/340 |
| 2,708,499 | 5/1955 | Patzer | 194/321 |
| 4,190,145 | 2/1980 | Paret | 194/339 |

FOREIGN PATENT DOCUMENTS

| | | | |
|---|---|---|---|
| 6863 | of 1890 | United Kingdom | 194/339 |

*Primary Examiner*—F. J. Bartuska

*Attorney, Agent, or Firm*—Burns, Doane, Swecker & Mathis

[57] ABSTRACT

A coin acceptor includes first and second members initially spaced apart from one another and frictionally carrying a third member having a coin selectively positioned thereon. Moving the first and second members toward one another causes relative displacement between the third member and the first and second members. The relative displacement is compared with a reference position.

25 Claims, 9 Drawing Sheets

COIN ACCEPTOR FOR VENDING MACHINE

BACKGROUND AND SUMMARY OF THE INVENTION

This application is a continuation-in-part of U.S. patent application Ser. No. 812,506 of Frank J. Koch entitled "Coin Acceptor for Vending Machine", filed on Dec. 23, 1985 now Pat. No. 4,705,153.

The present invention relates generally to mechanisms for receiving coins in vending machines and more particularly relates to mechanisms for vending machines wherein the weight of the coin is compared against a reference standard.

Numerous devices are known for receiving coins especially for use in vending machines Typically, such devices include slots or passageways within which the coin rolls. If the coin has sufficient mass, the coin can successfully traverse a series of check points in order to permit the vending machine to open or otherwise dispense its contents Representative examples of such coin acceptors for vending machines are disclosed in U.S. Pat. Nos. 494,653 of Smith; 1,442,941 of Grover; 1,798,172 of Seitz; 2,076,299 of Kloess; 2,256,486 of Lindberg; 2,339,823 of Vogel; 2,370,869 of Kay; 2,708,499 of Patzer; and 4,190,145 of Paret. More recently, such mechanisms have become increasingly complex and costly with many current mechanisms including complicated electronic circuitry and sensing devices.

In addition to the coin acceptors for vending machines, devices have been created for testing coins by way of gravity as on a balance beam. Examples of such devices include U.S. Pat. Nos. 13,840 of Allender and 216,184 of Hoag.

The need remains, however, for a coin acceptor especially for use in a vending machine which is simple in design and construction, dependable in operation and relatively inexpensive. For example, vending machines which dispense somewhat more expensive items such as cigarettes, must be durable yet relatively inexpensive in order to profitably permit the wide distribution of such vending machines Accordingly, it is an object of the present invention to provide a coin acceptor especially for use in a vending machine which is relatively simple in configuration yet durable and reliable in operation.

Another object of the present invention is to provide a coin acceptor for a vending machine which utilizes sliding friction in order to determine whether a proper coin or coins have been deposited Yet another object of the present invention is to provide a coin acceptor for a vending machine which utilizes sliding friction in order to compare the weight of the coin or coins deposited in the vending machine with a reference standard.

These and other objects of the present invention are realized by the apparatus and method according to the present invention wherein a coin acceptor includes first and second members which frictionally carry a third member. Means are provided for moving the first and second members toward one another. The weight of the coin or coins deposited on the third member causes the third member to be displaced a distance corresponding to the weight of the coin. In a first preferred embodiment, if the third member has been displaced a predetermined amount, the coin acceptor will permit the vending machine or similar device to be opened or to otherwise dispense the contents of the vending machine.

In a second preferred embodiment, the third member is braced to prevent horizontal movement thereof and forces are applied to the first and second members for moving them toward one another. By comparing the relative displacement of each of the first and second members with respect to the third member, the coin acceptor will be able to determine if the coin being tested is of a proper weight.

BRIEF DESCRIPTION OF THE DRAWINGS

The preferred embodiments of the present invention will be described with reference to the accompanying drawings wherein like members bear like reference numerals and wherein.

DETAILED DESCRIPTION OF THE PREFERRED EMBODIMENTS

Figure 1:
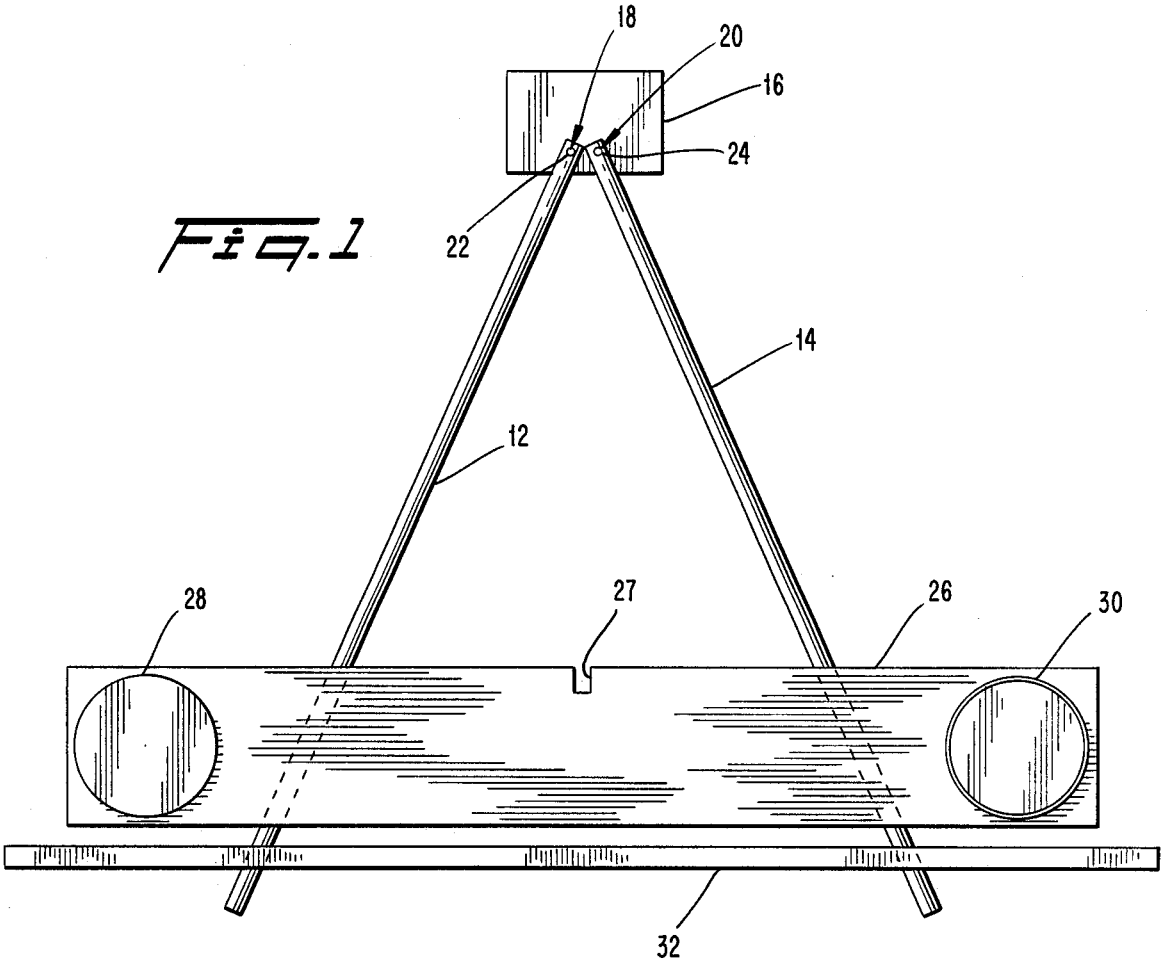
FIG. 1 is a top view of a first preferred embodiment of the coin acceptor according to the present invention in an initial configuration.

With reference now to FIG. 1, a first preferred embodiment of a coin acceptor according to the present invention includes first and second members 12, 14 which are spaced apart from one another in an initial configuration. In the first preferred embodiment, the members 12, 14 are metal rods (for example of brass) which are pivotably mounted at one end to a support 16. The pivotal connection 18, 20 of the rods 12, 14 may be accomplished, for example, by a pin 22, 24 which is received within a passageway provided in a first end of each of the rods 12, 14. The pivot points 18, 20 are positioned adjacent to one another but are sufficiently spaced apart so as to permit the rods 12, 14 to be moved freely toward and away from one another.

A third member 26 is carried by the first and second rods 12, 14 in the initial configuration with the third member being frictionally engaged by an upper surface of the first and second rods 12, 14. The third member 26 comprises a bar (for example of metal) having a sufficient length so as to extend beyond the spaced apart ends of the rods 12, 14 and having sufficient width so as to be frictionally engaged by the rods 12, 14. The third member may be provided with a slot 27 which may be compared with a reference position whereby the distance which said third member has been displaced may be determined.

A reference member 28 is provided at one end of the bar 26 with a coin to be tested 30 provided at the other end of the bar 26. A fourth member 32 is provided for moving the first and second rods 12, 14 toward one another with the result that the bar 26 is displaced a distance proportionate to the weight of the coin 30 relative to the reference weight 28.

Figure 2:
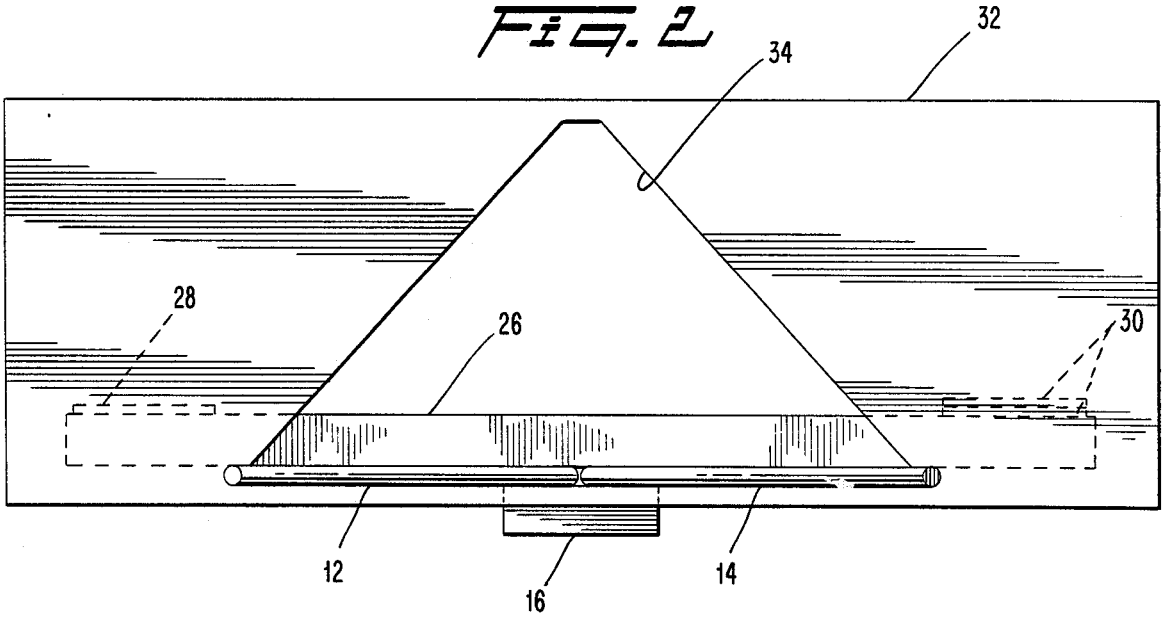
FIG. 2 is a side view of the coin acceptor of FIG. 1.

With reference now to FIG. 2, the member 32 is provided with a triangular slot 34 with the rods 12, 14 extending through the triangular slot 34.

Figure 3:
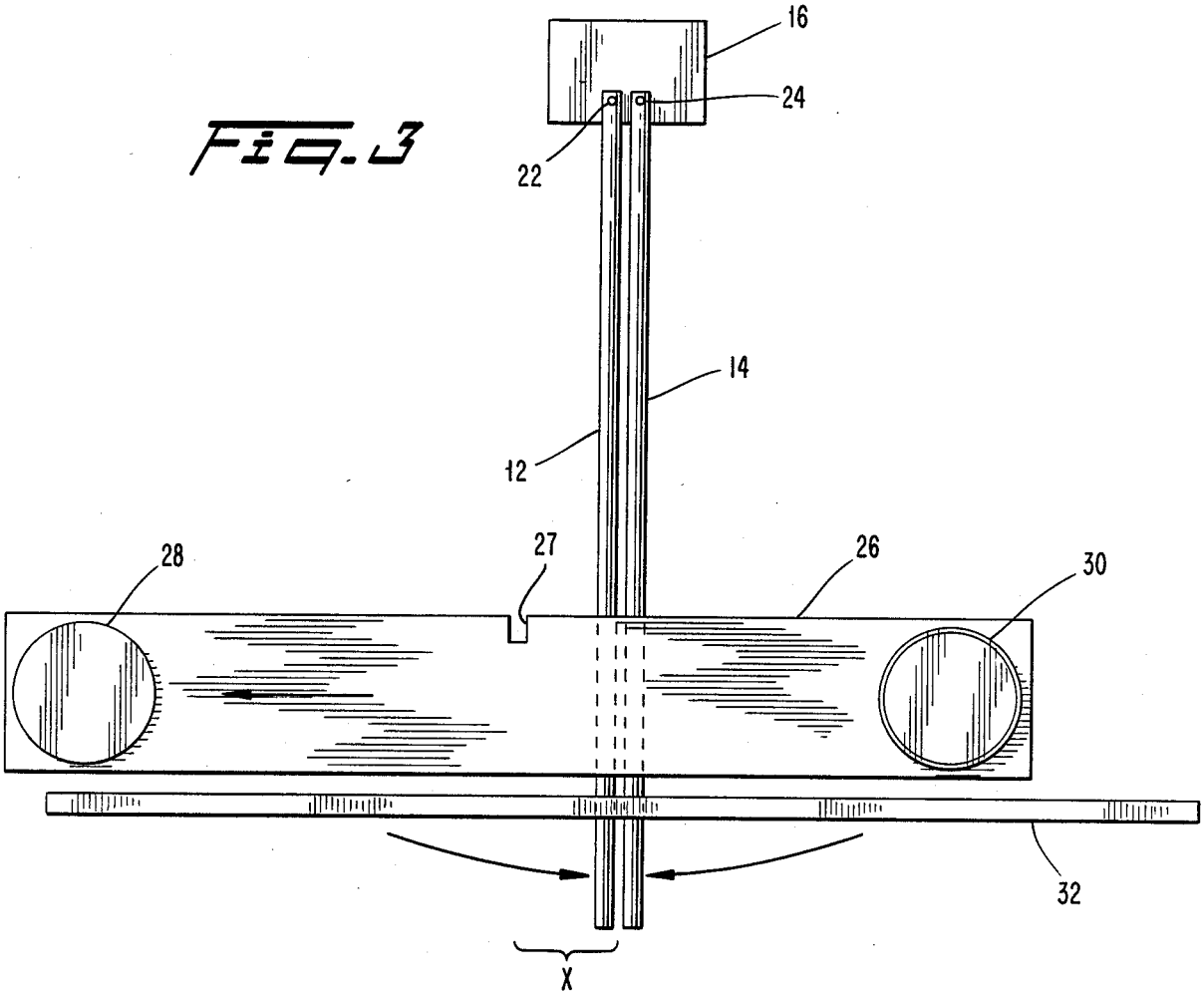
FIG. 3 is a top view of the coin acceptor of FIG. 1 in a subsequent configuration.
Figure 4:
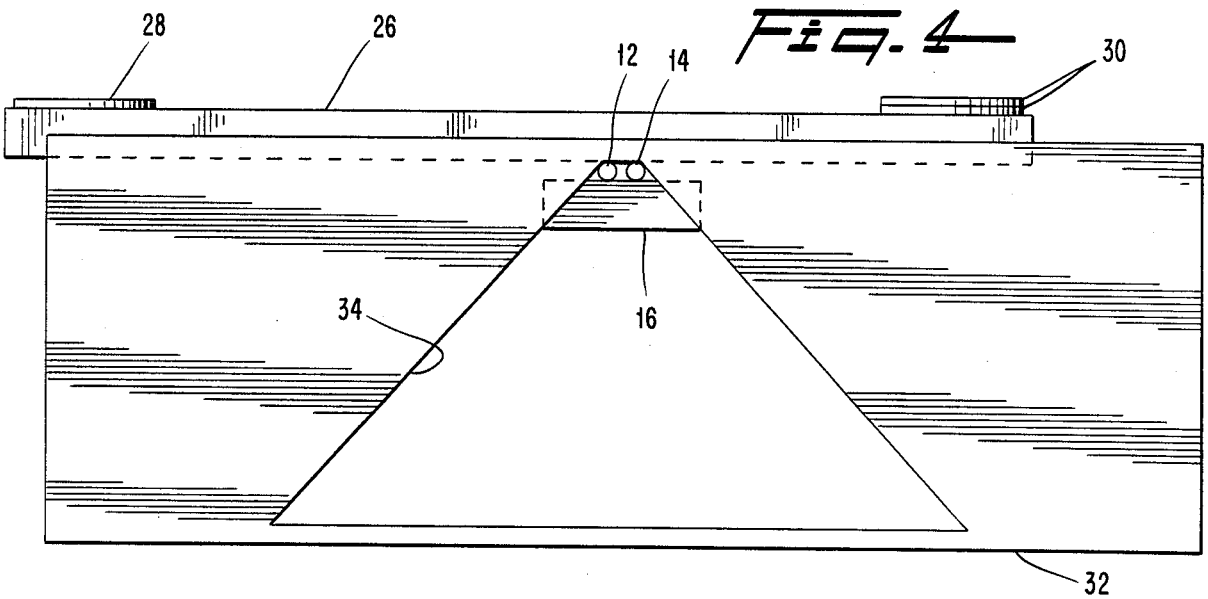
FIG. 4 is a side view of a coin acceptor of FIG. 3.

With reference now to FIG. 3, the panel 32 has been moved vertically downwardly to urge the rods 12, 14 toward one another. Consequently, the bar 26 has been displaced a distance X which corresponds to the ratio of the weight of coins 30 with respect to the reference weight 28. In the first preferred embodiment illustrated in FIGS. 1–4, the coins 30 weigh twice as much as the reference standard 28 and the bar 26 was initially equally spaced with respect to the rods 12, 14. Consequently, the friction between the bar 26 and the rod 14 was greater than the friction between the bar 26 and the rod 12 with the result that the bar 26 was moved to the left as shown in FIG. 3. More precisely, the distance which the bar 26 is displaced to the left in FIG. 3 corresponds to the difference in weight of the left and right portions of the bar 26 with the coins or other weights provided thereon. Therefore, if the bar 26 were not initially centered on the rods 12, 14 and if the bar 26 has sufficient mass so as not to be negligible, the difference in weight of the left side of the bar 26 as compared with the right side of the bar 26 (assuming that the bar is not centered on the rods 12, 14) will affect the distance that the bar 26 is displaced upon movement of the rods 12, 14 toward one another In the first preferred embodiment, the bar 26 is initially centered on the rods 12, 14 and the mass of the bar 26 is not significantly greater than the weight of the reference standard 28 and coins 30.

As will be readily obvious to one skilled in the art, the reference weight 28 can be eliminated or replaced by a portion of the bar 26 if so desired.

Figure 5:
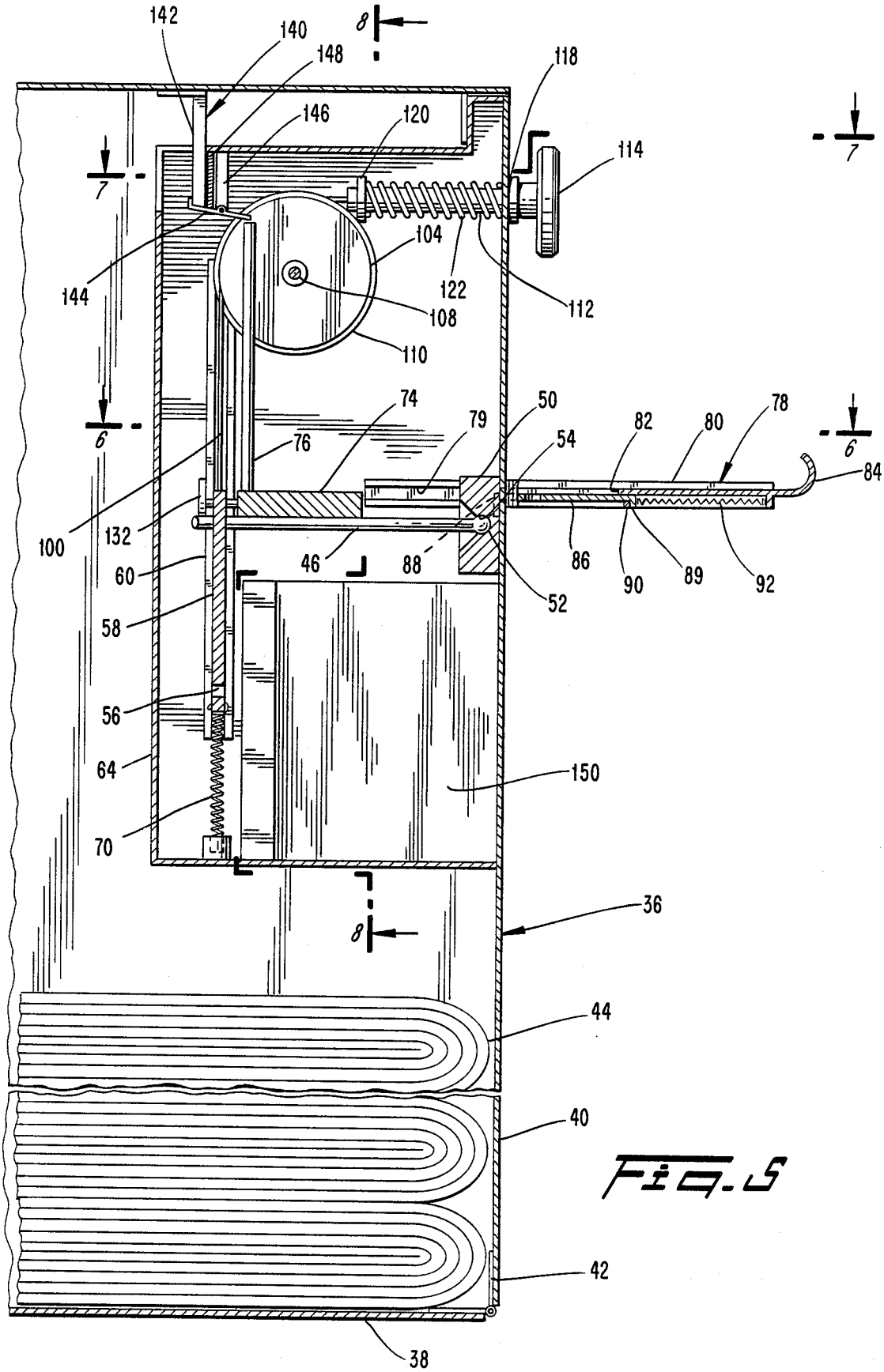
FIG. 5 is a cross-sectional view of a vending machine including the first preferred embodiment of the coin acceptor according to the present invention.

With reference now to FIG. 5, the first preferred embodiment of the coin acceptor according to the present invention is provided in a vending machine 36 which includes a housing 38 and a door 40. The door 40 is pivotably connected to the housing 38 by a hinge 42 provided along a lowermost edge of the door 40.

The vending machine 36 of the first preferred embodiment dispenses newspapers 44 which are provided in a lower chamber of the interior of the vending machine 36. It will be readily obvious to one skilled in the art that the coin acceptor for a vending machine according to the present invention can be adapted for and utilized in a wide variety of vending machines other than those for newspapers and the like. For example, the coin acceptor of the vending machine can be readily adapted for use in dispensing candy, cigarettes, soda pop and other articles which are commonly dispensed in vending machines.

In the coin acceptor of FIG. 5, a pair of rods 46, 48 are pivotably mounted in a support 50 which is fixed to the door 40 of the vending machine. The rods 46, 48 have generally spherical ends 52 which are received within a socket 54 of the support 50. The socket 54 is configured so as to allow the rods 46, 48 to be moved freely toward one another in a horizontal plane and also to permit the rods 46, 48 to be pivoted upwardly and downwardly a limited extent.

The rods 46, 48 (see also FIG. 6) extend substantially horizontally through an opening 56 in a third member 58. The opening 56 comprises a V-shaped slot having sufficient width so as to permit the rods 46, 48 to slide freely within the slot 56. The member 58 comprises a flat panel which is slidably received within two brackets 60, 62 which are rigidly fixed to a housing 64 that is attached to the door 40. Each of the brackets 60, 62 is provided with a channel 66, 68 which slidably receives a corresponding edge of the panel 58. The panel 58 is resiliently attached to a lower wall of the housing 64 by a pair of springs 70, 72. The springs 70, 72 are sufficiently resilient to return the panel 58 to an initial configuration but permit the panel 58 to be moved vertically upon actuation of the vending mechanism.

As will be readily obvious to one skilled in the art, the rods 46, 48 could be mounted parallel to one another (for example in tracks and not pivotably mounted) for sliding movement toward and away from one another. In addition, the first and second members could be shorter than the width of the third member and could carry the third member on edges if desired. Moreover, the fourth member 58 could be replaced by slots formed by a plurality of wires (not shown) which are moved toward and away from one another. Alternatively, the first and second members could be moved toward and away from one another by arms (not shown) or in other suitable ways so as to accomplish the present invention.

With reference again to FIG. 5, a bar 74 is frictionally engaged by an upper surface of the rods 46, 48 and is carried by the rods 46, 48. The bar 74 is generally flat in configuration and the rods 46, 48 and the bar 74 correspond to the rods 12, 14 and the bar 26 of FIG. 1. The bar 74 is provided with a pin 76 which extends vertically with respect to the bar 74.

A mechanism 78 is provided for selectively positioning at least one coin on the bar 74. The mechanism 78 provides a channel 79 which slidably receives a coin holder 80 having a U-shaped slot 82 (see FIG. 7). The coin holder 80 has a handle 84 which extends a predetermined distance beyond the U-shaped slot 82. A coin support 86 is carried by the coin holder 80 on the underside thereof with the coin support 86 including a first shoulder 88 at one end which abuts the door 40 of the vending machine 36 and a second shoulder 89 which abuts a stop 90 of the coin holder 80. The coin support 86 is resiliently urged toward the door 40 by a spring 92. The mechanism 78 is positioned and configured so that a coin which is selectively positioned in the U-shaped slot 82 can be urged toward the bar 74 manually by an individual. As the coin and coin holder 80 are urged toward the door, the coin support 86 is likewise moved beneath the coin holder 80 so as to support the coin until the coin holder 80 reaches the bar 74. The coin support 86 is prevented by the stop 89 which abuts the door 40 of the vending machine from continuing the entire distance with the coin holder 80.

The panel 58 is carried by two cables 100, 102 which are carried on respective pulleys 104, 106. The pulleys 104, 106 are carried on a common shaft 108 with the pulleys 104, 106 fixed with respect to the shaft 108. The ends of the cables 100, 102 are fixed at a suitable position on the circumference of the pulleys 104, 106. A third pulley 110 is also fixedly mounted on the shaft 108 (see FIG. 7). A spring biased rod 112 having a knob 114 is connected to a cable 116 which passes over the circumference of the pulley 110. The rod 112 is provided with a first stop 118 which limits the movement of the rod 112 toward the door 40 and a second stop 120 which secures the spring 122 between the stop 120 and the door 40 and also prevents the rod 112 from being pulled beyond a predetermined distance relative to the door 40.

Figure 8A:
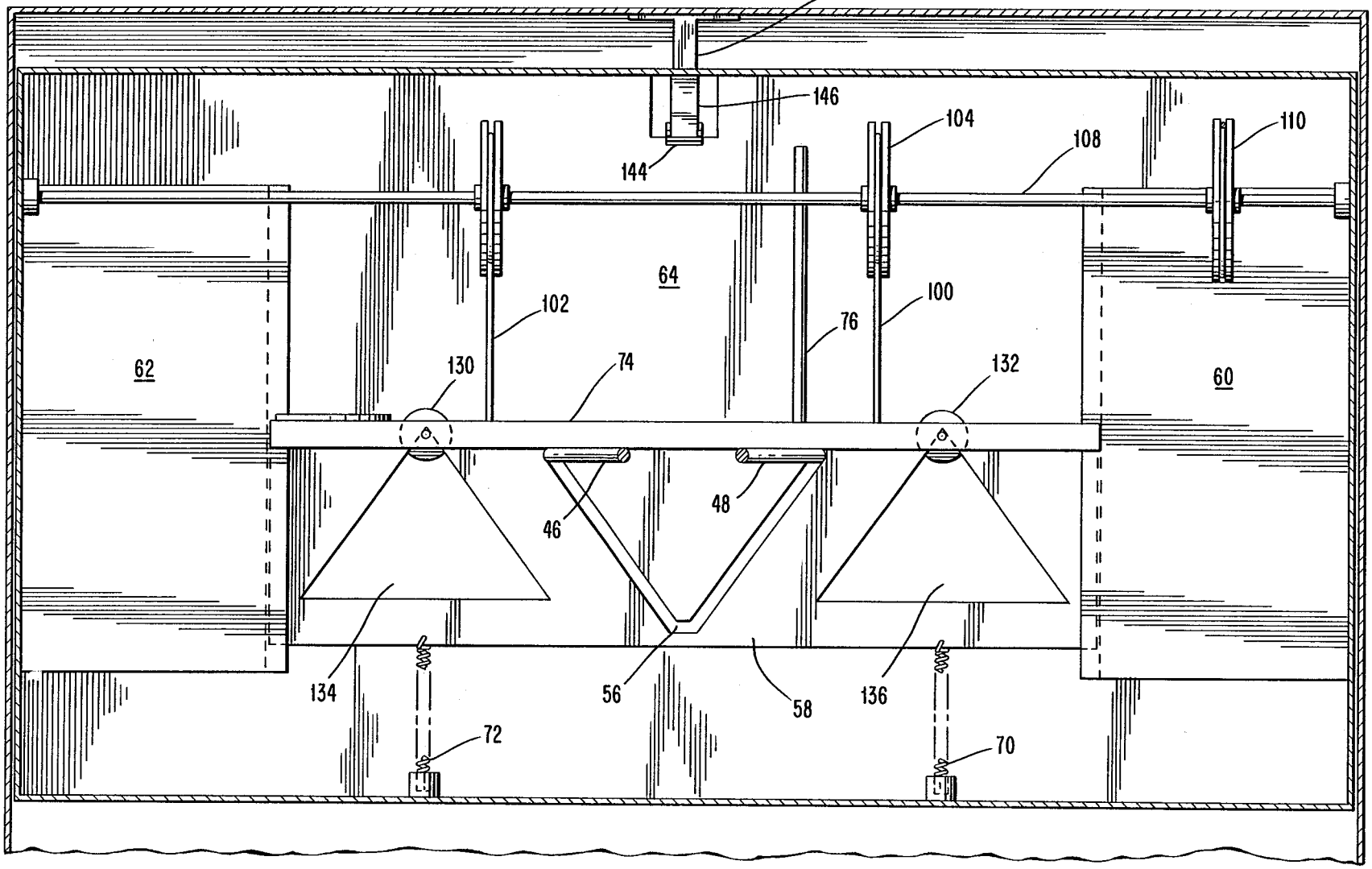
FIG. 8*a* is a view along the line 8—8 of FIG. 5 in an initial configuration.
Figure 8B:
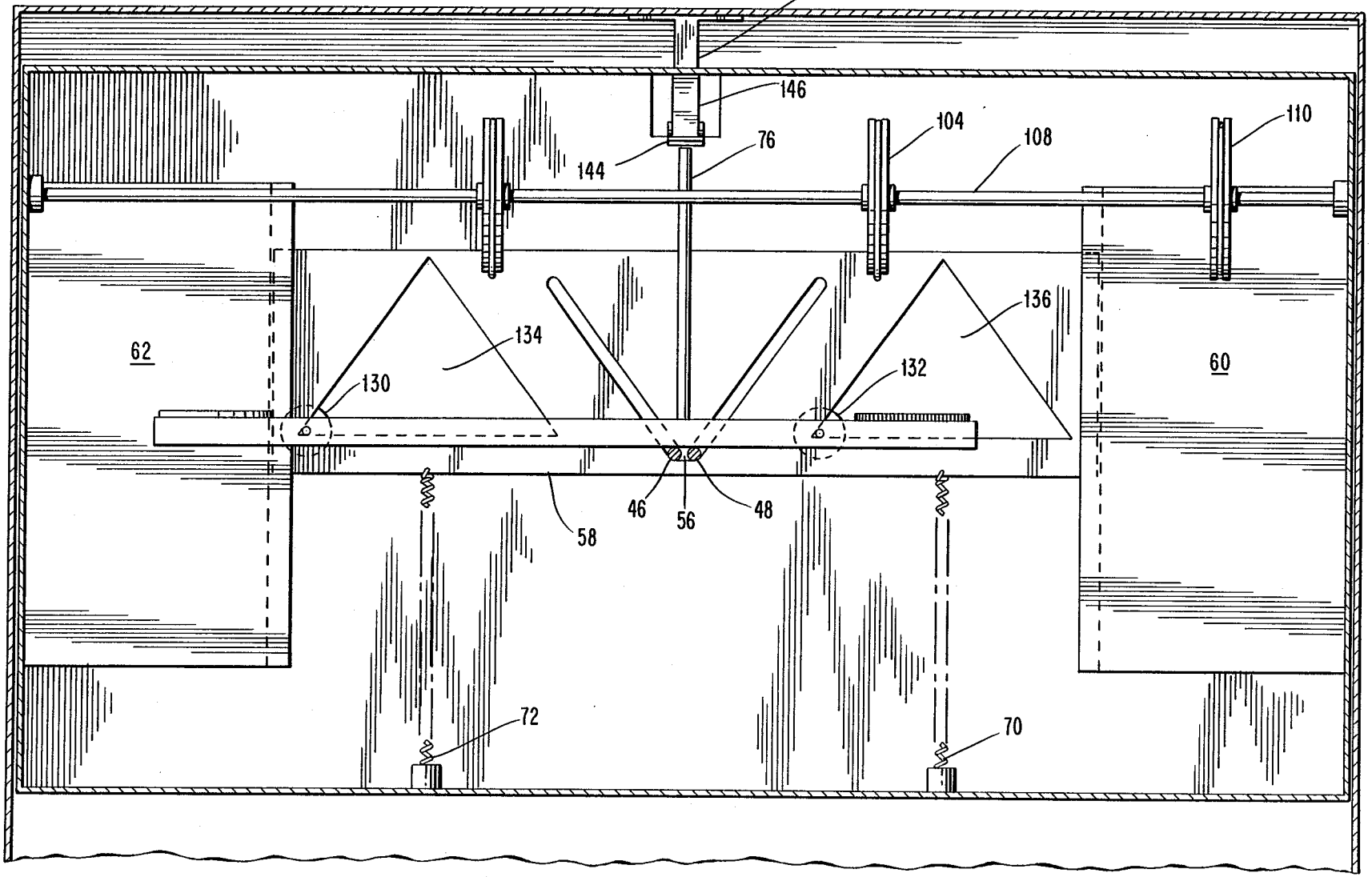
FIG. 8*b* is a view along the line 8—8 of FIG. 5 in a subsequent position.

The bar 74 is provided with two pins 124, 126 (see FIG. 6) which extend through the panel 58. The pins 124, 126 have buttons 130, 132 which help to maintain the bar 74 in the predetermined configuration with respect to the panel 58. With reference to FIGS. 8*a* and 8*b*, the pins 124, 126 are received within triangular passageways 134, 136 provided in the panel 58

With reference again to FIG. 5, a latch mechanism 140 for the door 40 includes a catch 142 which is fixedly mounted on the top portion of the housing 38 so as to extend into the coin acceptor housing 64 through an opening in the housing when the door 40 is in a closed configuration. A pivotably mounted catch 144 is carried by a support 146 which is fixedly mounted to an upper portion of the housing 64. A spring 148 maintains the catch 144 in an upwardly biased configuration so that the catch 144 remains securely engaged with the catch 142 when the door 40 is in the closed configuration. The pin 76 of the bar 74 is positioned so that it will engage an end of the catch 144 when the bar 74 has been displaced to a preselected position in the manner described. A coin box 150 is provided beneath the bar 74 to receive the coins which have been selectively positioned on the bar 74 after the coin acceptor mechanism has been actuated.

In operation, the coin acceptor mechanism is configured in the initial position as shown in FIG. 5. An individual positions a coin such as a quarter in the U-shaped slot of the coin holder 80 and then urges the coin holder 80 inwardly toward the bar 74. The coin is pushed onto the top surface of the bar 74 and the coin holder 80 is then retracted. While the coin holder 80 is pushed inwardly, the coin support 86 prevents the coin from falling downwardly into the coin box 150 while the coin is being moved onto the bar 74. The individual then pulls the knob 114 so as to rotate the pulleys 104, 106 and 110. Rotation of the pulleys 104, 106 pulls the panel 58 upwardly so as to urge the rods 46, 48 toward one another. The bar 74 is then displaced laterally, a position which corresponds to the weight of the coin with respect to a reference standard provided on the other end of the bar 74. When the rods 46, 48 have reached the bottom of the V-shaped slot 56, further pulling of the knob 114 causes the rods 46, 48 and the bar 74 to move upwardly a slight amount. If the bar 74 has been displaced to a predetermined position, the pin 76 will be positioned immediately beneath a projecting end of the catch 144. Further pulling of the knob 114 will cause the pin 76 to release the latch 140 as the door is opened. Accordingly, by pulling on the knob 114, the movement of the rods toward one another, the displacement of the bar 74 and the release of the latch 140 are accomplished in one step. As the door is pivoted downwardly, the coin will slide off of the bar 74 into the coin collection box 150. It should be noted that the reference standard should be securely fixed to the bar 74 so as to prevent the reference standard from falling into the collection box 150. Furthermore, a keyed passageway (not shown) may be provided for periodically selectively removing the coins from the coin collection box 150. If the bar 74 has not been displaced to the preselected position (for example because the coin was too heavy or too light), the rod 76 will not engage the catch 144 to release the latch. The bar 74, rods 46 and 48 and pin 76 will pivot upwardly a sufficient amount, however, so as to cause the coin to nevertheless drop into the coin box 150.

Upon release of the knob 114, the springs 70 and the spring 122 will cause the panel 58 to move downwardly. Movement of the panel 58 downwardly will cause the rods 46, 48 to move apart from one another to the initial configuration and will also cause the bar 74 to return to the initial configuration. The pins 122, 124 will be engaged by the surfaces of the triangular passageways 134, 136 to displace the bar 74 to the initial configuration. The passageways 134, 136 are sufficiently wide so as not to obstruct the displacement of the bar 74 on the rods 46, 48 regardless of the weight of the coin which is provided on the bar 74.

Figure 10:
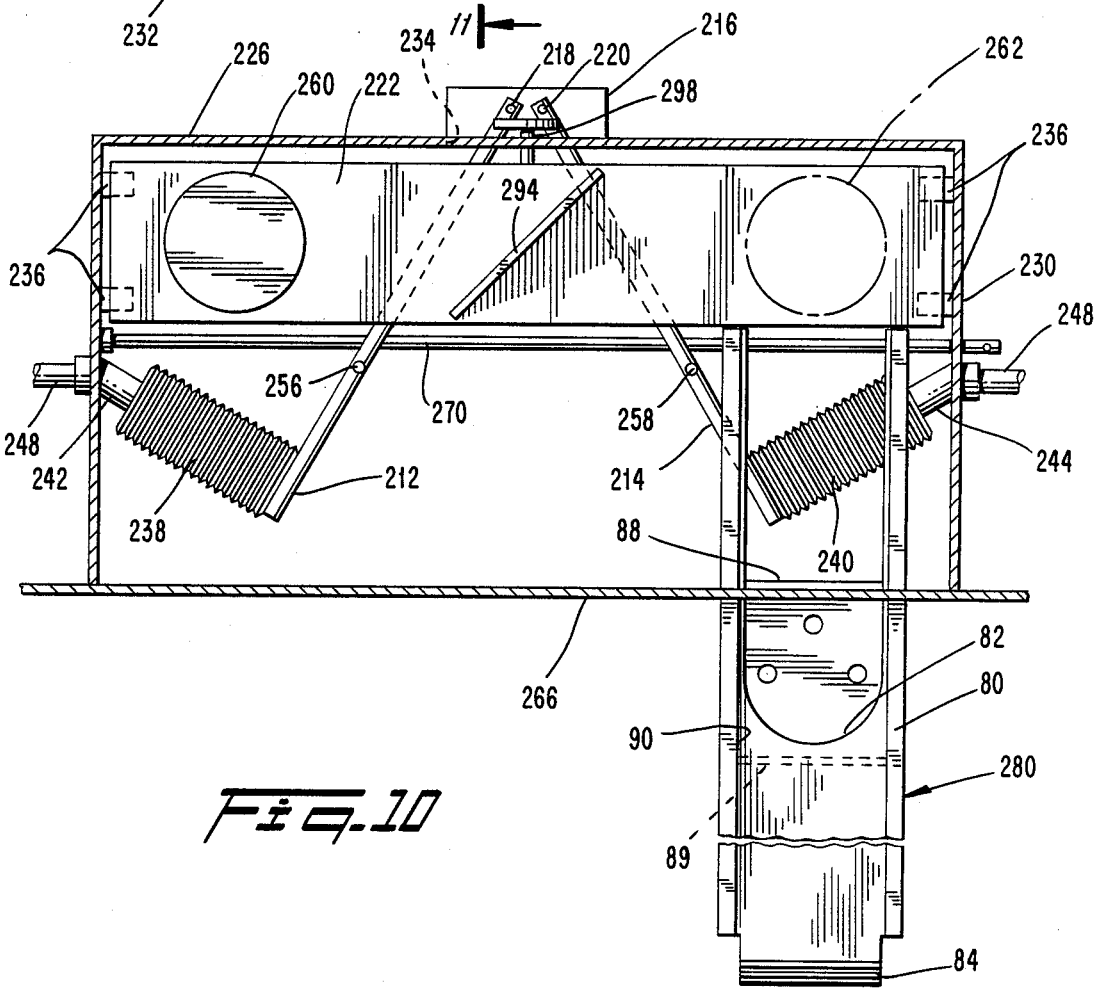
FIG. 10 is a view along the line 10—10 of FIG. 9.

With specific reference to FIG. 10, a second preferred embodiment of the coin acceptor according to the present invention includes first and second rods 212, 214 that are preferably comprised of metal, such as brass. The first and second rods 212, 214 are pivotably mounted at one end to a support, such as a ledge 216. The pivotal connection of the rods 212, 214 may be accomplished, for example, by a pin 218, 220 which is received within a passageway provided in a first end of each of the rods 212, 214. The pivot pins 218, 220 are positioned adjacent to one another but are sufficiently spaced apart so as to permit the rods 212, 214 to be moved freely toward and away from one another.

A bar 222 is supported by the first and second rods 212, 214 with a lower surface of the bar 222 being frictionally engaged by an upper surface of the first and second rods 212, 214. The bar 222 is preferably comprised of metal, and is of sufficient length so as to extend beyond the spaced apart ends of the rods 212, 214. The bar 222 also is of a sufficient width so as to be frictionally engaged by the rods 212, 214. The bar 222 may be hollow to minimize its weight with respect to the weight of the coins to be tested.

Figure 9:
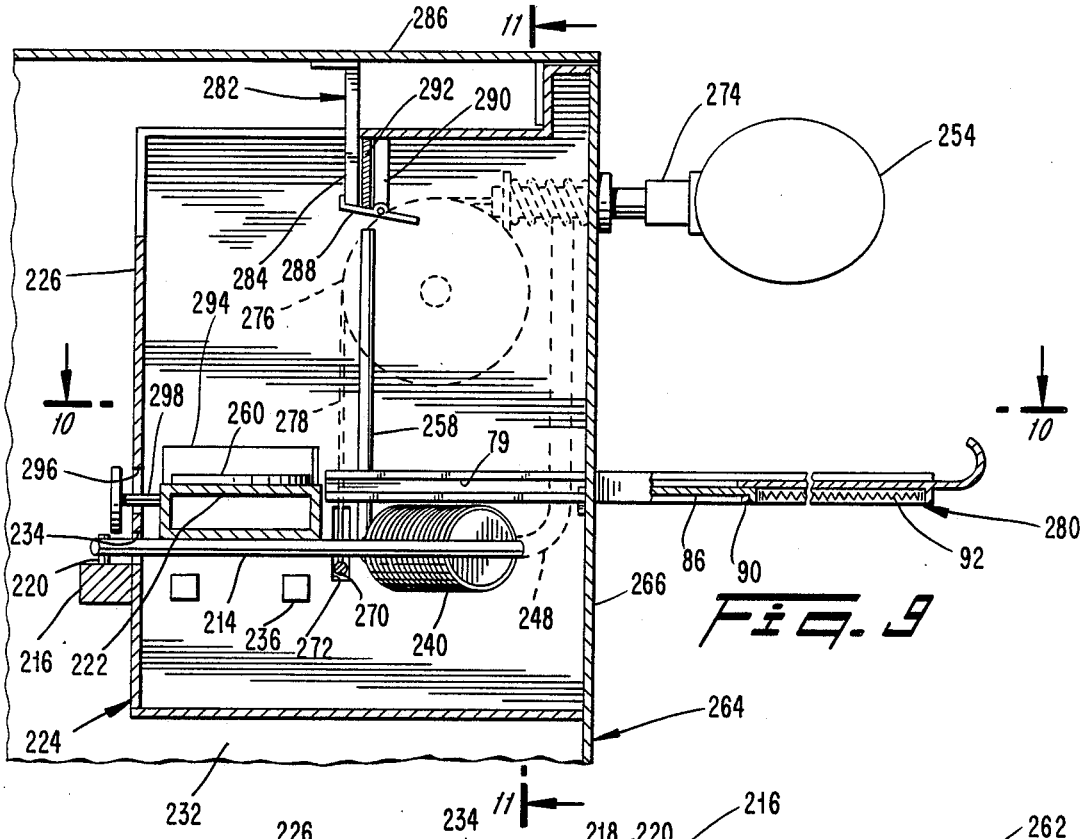
FIG. 9 is a side view, in partial cross section, of a portion of a vending machine including a second preferred embodiment of the coin acceptor according to the present invention with a hydraulic system shown schematically.

With reference to FIGS. 9 and 10, a housing 224 is provided for supporting the second preferred embodiment of the coin acceptor according to the present invention. The housing 224 includes a rear wall 226, side walls 228, 230, and a floor 232. The rear wall 226 supports the ledge 216, and is further provided with an elongated horizontal slot 234.

The rods 212, 214 extend through the slot 234, which is wide enough to allow pivotal movement of the rods 212, 214 in a horizontal direction, and to a limited extent in the vertical direction.

Support tabs 236 are mounted to the side walls 228, 230 below the bar 222. When the bar 222 is supported horizontally by the rods 212, 214, it will not contact the support tabs 236. However, should an imbalance occur on the bar 222, the tabs 236 will prevent the bar 222 from falling off of the rods 212, 214. This is particularly important when both of the rods 212, 214 are adjacent one another at the center of the bar 222.

With reference to FIG. 10, inflatable bellows 238, 240 are interconnected between the free ends of the rods 212, 214 and their adjacent side walls 228, 230. The walls of the bellows 238, 240 are preferably pleated in accordion-like folds and are comprised of a resilient material. These bellows 238, 240 are designed such that when they are inflated they expand in a longitudinal direction. The relaxed configuration of the bellows 238, 240 is in a contracted mode. The bellows 238, 240 are sealed at the end attached to the rods 212, 214, and an inlet 242, 244 is provided at the other end of each of the bellows 238, 240.

Figure 11:
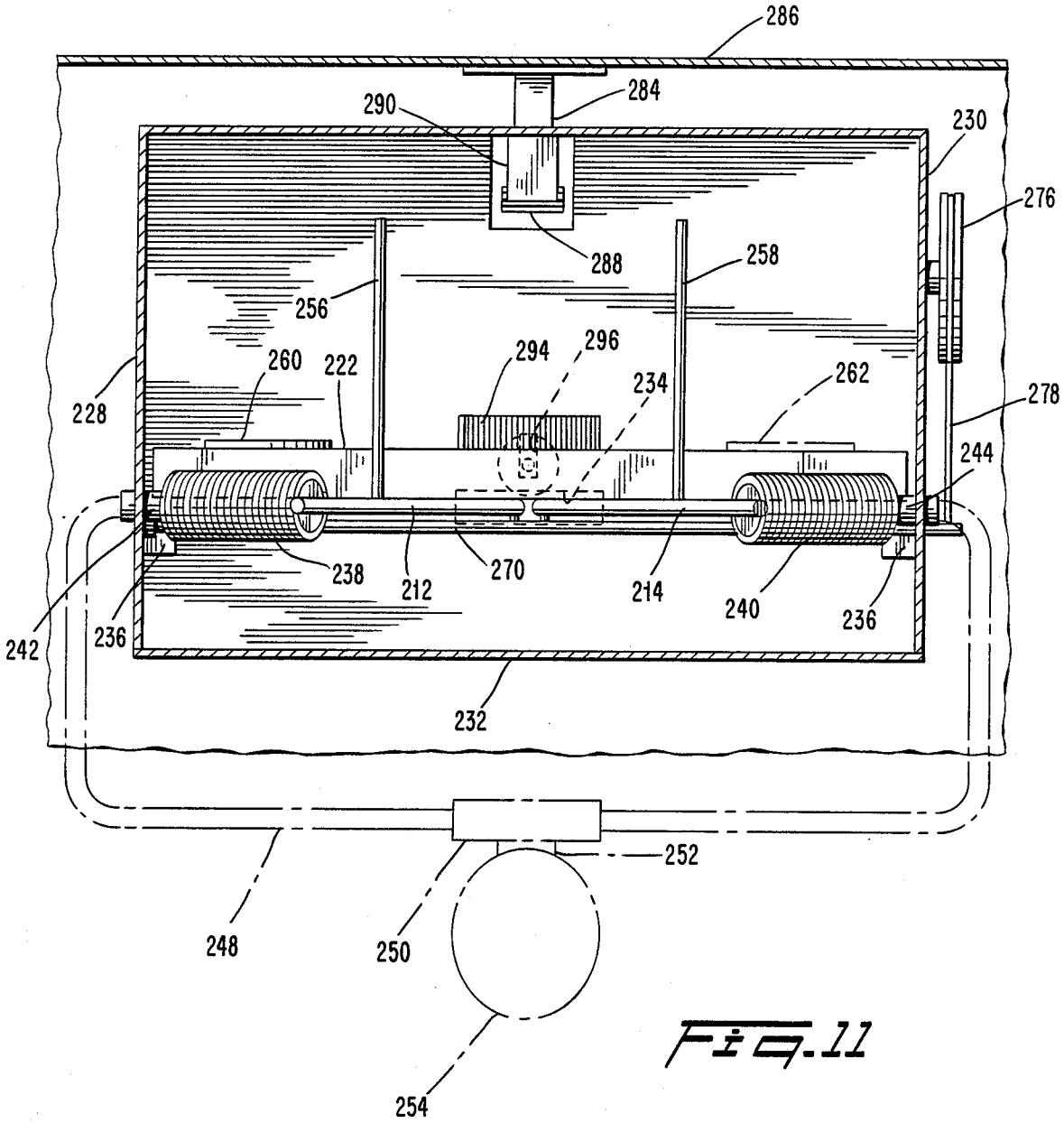
FIG. 11 is a view along the line 11—11 of FIG. 9.

With specific reference to FIG. 11, the inlets 242, 244 are connected to a pneumatic system 246 that includes tubing 248 leading from each inlet 242, 244 to a T-section 250. The T-section 250 is connected to another tube 252 that is attached to a squeezable bulb 254 or other suitable means for generating a small burst of pressure.

Pins 256, 258 are mounted in a vertical position on the rods 212, 214 near the ends to which the inflatable bellows 238, 240 are mounted.

With specific reference to FIGS. 10 and 11, a reference member 260, such as a coin or an object with a weight similar to a coin, is mounted on one end of the bar 222. A coin 262, or other object to be tested is placed on the opposite end of the bar 222 such that the reference member 260 and the test coin 262 are symmetrically spaced with respect to the rods 212, 214. The bulb 254 is then squeezed to apply equal increments in pressure to the bellows 238, 240.

The pressure increase in each of the bellows 238, 240, causes them to inflate and expand longitudinally. Since the pressure in the bellows 238, 240 is equal, the forces acting on each of the rods 212, 214 is also equal. If the reference member 260 and the coin 262 to be tested are of a substantially equal weight, the frictional drag created between the bar 222 and each of the rods 212, 214 would be substantially equal. In that situation, the rods 212, 214 will move inwardly until they contact each other in the center of the bar 222. Movement of the bar 222 is restrained by the side walls 228, 230.

If the coin 262 being tested is of a different weight than the reference member 260, the frictional drag exerted by the bar 222 on each of the rods 212, 214 will be different. Since one of the rods 212, 214 will have greater frictional drag than the other of the rod, when moving across the bar 222, the one rod will travel at a slower speed than the rod having the less frictional drag. In this situation, the rods 212, 214 will not meet each other at the center of the bar 222, but rather will meet at some other location.

Accordingly, by comparing the position where the two rods 212, 214 meet each other with a reference position, such as the midsection of the bar 222, it can be determined if the coin 262 is of a predetermined weight. When the bulb 254 is released, the pressure in the bellows 238, 240 is reduced, and the resiliency of the bellows 238, 240 causes the bellows 238, 240 to contract, thus returning the rods 212, 214 to their original spaced apart configuration.

With continued reference to FIGS. 9–11, the second preferred embodiment of the coin acceptor according to the present invention is provided on a vending machine 264, only a portion of which is illustrated.

With specific reference to FIGS. 9 and 10, the floor 232 and the side walls 228, 230 of the housing 224 of the coin acceptor are mounted to the inside of a door 266 of the vending machine 264. An opening 268 is provided through the door 266 at a level above the bar 222.

A support beam 270 is mounted horizontally between the side walls 228, 230 directly below the rods 212, 214. The beam is pivotally mounted in the left wall 228, and guided within a slot 272 in the right side wall such that a portion of the beam 270 projects through the slot 272 and may be raised vertically. The purpose of the beam 270 is to provide support for the rods 212, 214, and to provide a means for lifting the rods 212, 214.

A spring biased rod 274 is mounted in the opening 268 of the door 266. At the end of the rod 274 projecting outside of the vending machine, the bulb 254 is provided Rotatably mounted to the outside of the wall 230 is a pulley 276. The pulley 276 is arranged in alignment with both the rod 274 and the portion of the support beam 270 projecting through the slot 272 of the side wall 230. A cable 278 is connected to the rod 274, passes over the pulley 276 and is fastened to the end of the rod 270 projecting through the slot 272.

Figure 6:
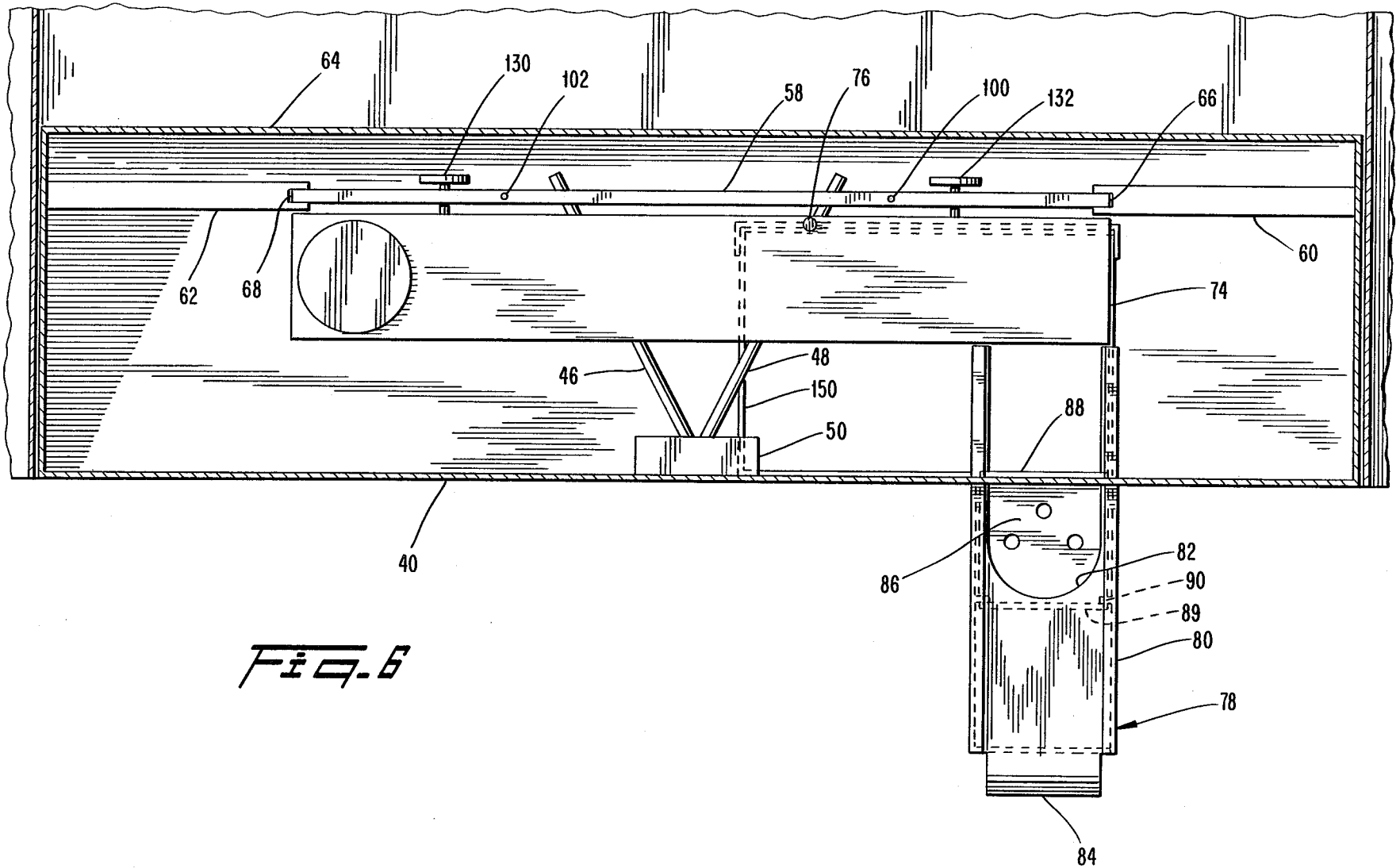
FIG. 6 is a view along the line 6—6 of FIG. 5.
Figure 7:
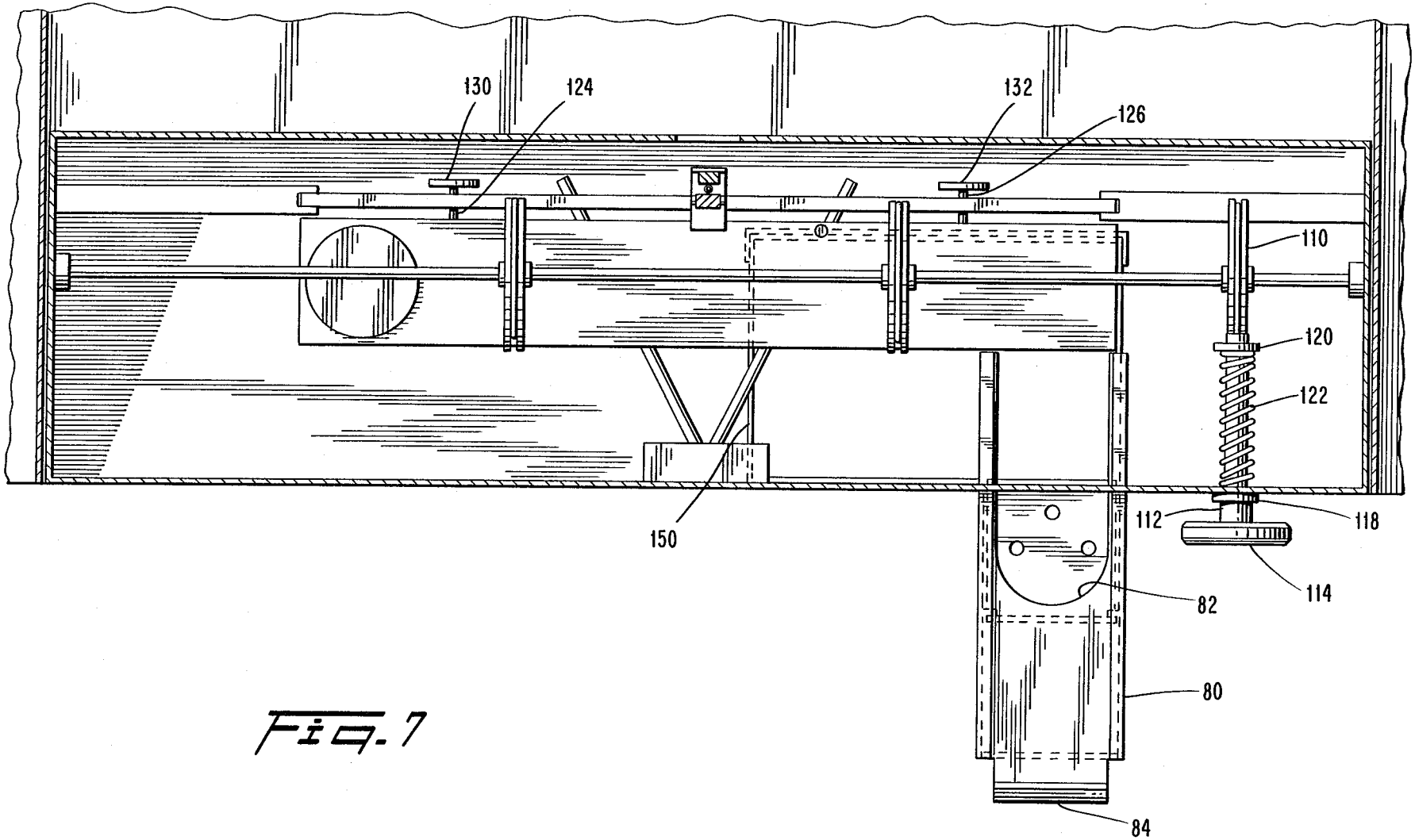
FIG. 7 is a view along the line 7—7 of FIG. 5.

A mechanism 280 is provided for selectively positioning at least one coin on the bar 222. Like parts of the embodiment of FIGS. 5, 6, and 7 are given corresponding reference numerals in the embodiment of FIGS. 9 and 10. The mechanism 280 provides a channel 79 which slidably receives a coin holder 80 having a U-shaped slot 82 (see FIG. 10). The coin holder 80 has a handle 84 which extends a predetermined distance beyond the U-shaped slot 82. A coin support 86 is carried by the coin holder 80 on the underside thereof with the coin support 86 including a first shoulder 88 at one end which abuts the door 266 of the vending machine 264 and a second shoulder 89 which abuts a stop 90 of the coin holder 80. The coin support 86 is resiliently urged toward the door 266 by a spring 92. The mechanism 280 is positioned and configured so that a coin which is selectively positioned in the U-shaped slot 82 can be urged toward the bar 222 manually by an individual. As the coin and coin holder 80 are urged toward the door, the coin support 86 is likewise moved beneath the coin holder 80 so as to support the coin until the coin holder 80 reaches the bar 222. The coin support 86 is prevented by the stop 89 which abuts the door 266 of the vending machine from continuing the entire distance with the coin holder 80.

With reference to FIG. 9, a latch mechanism 282 is provided for latching the door 266. A tab 284 is fixedly mounted on a top portion 286 of the vending machine 264 so as to extend into the housing 224 of the coin acceptor when the door 266 is in a closed configuration. A pivotably mounted catch 288 is carried by a support 290 which is fixedly mounted to an upper portion of the housing 224. A spring 292 maintains the catch 288 in a upwardly biased configuration so that the catch 288 remains securely engaged with the tab 284 when the door is in the closed configuration. The catch 288 is arranged such that if the rods 212, 214 are positioned in the center of the bar 222, then the pins 256, 258 will be positioned directly below the lower portion of the catch 288.

To operate the second preferred embodiment of the coin acceptor according to the present invention, the coin 262 to be tested is positioned on the bar 222 by means of the coin depositor 280. The bulb 254 at the end of the rod 274 is then squeezed to apply pressure to the bellows 238, 240.

The increased pressure in the bellows 238, 240 causes them to expand longitudinally while applying a force to move the rods 212, 214 inwardly. Because of the symmetry of the arrangement, equal forces are applied to the rods 212, 214 by the bellows 238, 240. If the coin 262 is of equal weight as the reference member 260, then the frictional drag between the bar 222 and each of the rods 212, 214 will be similar. In that situation, the rods 212, 214 will travel toward each other at equal speeds and will meet at the center of the bar 222.

When the rods 212, 214 are at the center of the bar 222, then the pins 256, 258 are positioned directly below the catch 288. Pulling of the rod 274 will cause the cable 278 to raise the end of the support beam 270 engaged in the slot 272. The raising of the support beam 270 causes the beam 270 to engage and similarly raise the rods 212, 214 and the pins 256, 258. The raising of the pins 256, 258, when they are at the center of the bar 222, pivots the catch 288 so that it avoids the tab 284, thus allowing the door 266 to be opened. As the door 266 is pivoted downwardly, the coin 262 will slide off the bar 222 into a coin collection area at the floor 232 of the housing. A keyed passageway (not shown) may be provided for periodically removing the coins from the housing.

A slot 296 is provided at the center of the rear wall 226, and a pin 298 with an enlarged head extends from the bar 222 through the slot 296 so as to prevent the bar 222 from sliding off of the rods 212, 214 when the door is opened. The head of the pin 298 is preferably larger than the slot.

If the coin 262 to be tested is of a different weight than the reference member 260, then unequal amounts of friction will be applied to the rods 212, 214 by the bar 222. In that situation, upon activation of the bellows 238, 240 the rods 212, 214 will meet at a location other than the middle, and the pins 256, 258 will not actuate the catch 288. A stop bar 294 is positioned diagonally across the bar 222 at the midsection of the bar 222. If the door 266 does not open, the coin 262 on the bar 222 will slide toward the stop bar 294 when the beam 270 angles the bar 222. The coin 262 will then be deflected off of the bar 222 into the coin collection area.

Variations and changes to the present invention will become readily apparent to one skilled in the art upon reading the present specification. Thus, it is possible that an alternative embodiment may be employed wherein unequal amounts of pressure are applied to the bellows 238, 240 and the rods 212, 214 would meet at a position other than the center of the bar 222 to indicate a genuine coin.

Thus it is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced thereon.

What is claimed is:

1. An object comparator, comprising:

first and second members spaced apart from one another in an initial configuration;

a third member having the object selectively positioned thereon and being supported by said first and second members with said third member being frictionally engaged by an upper surface of said first and second members;

means for preventing substantially horizontal movement of said third member;

means for moving said first and second members toward one another whereby the relative movement of each of the first and second members with respect to the third member corresponds to the weight of the object; and means for comparing the relative movement with a reference position.

2. The object comparator of claim 1, wherein one end of each of said first and second members is pivotally mounted on a support with the other ends of the first and second members initially spaced apart from one another in said initial configuration.

3. The object comparator of claim 1, wherein the means for moving the first and second members toward one another moves the first and second members simultaneously.

4. The object comparator of claim 1, wherein the means for moving the first and second members toward one another moves the first and second members with equal force.

5. The object comparator of claim 2, wherein said first and second members are rods and wherein said third member is a bar.

6. The object comparator of claim 2, wherein said means for moving said first and second members toward one another includes a pneumatic system having inflatable bellows interconnected between a housing and the other ends of the first and second members.

7. The object comparator of claim 6, wherein said moving means further comprises a source of pressure directed into the bellows.

8. The object comparator of claim 7, wherein the bellows have a resiliency that returns the first and second members to their initial configuration when no pressure is applied to the bellows.

9. A coin acceptor for a vending machine, comprising:

first and second members spaced apart from one another in an initial configuration;

a third member supported by said first and second members with said third member being frictionally engaged by an upper surface of said first and second members;

means for preventing substantially horizontal movement of said third member;

means for selectively positioning a coin on said third member;

means for moving said first and second members toward one another whereby the relative movement of each of the first and second members with respect to the third member corresponds to the weight of the coin; and means for vending an article when said first and second members are displaced to a predetermined position relative to a reference position

10. The object comparator of claim 9, wherein the means for moving the first and second members toward one another moves the first and second members simultaneously.

11. The object comparator of claim 9, wherein the means for moving the first and second members toward one another moves the first and second members with equal force.

12. The coin acceptor of claim 9, wherein one end of each of said first and second members is pivotally mounted on a support with the other ends of the first and second members initially spaced apart from one another in said initial configuration.

13. The coin acceptor of claim 9, wherein said first and second members are rods and wherein said third member is a bar.

14. The coin acceptor of claim 9, wherein said means for moving said first and second members toward one another includes a pneumatic system having inflatable bellows interconnected between a frame and the other ends of the first and second members.

15. The coin acceptor of claim 14, wherein said moving means further comprises a source of pressure directed into the bellows.

16. The coin acceptor of claim 14, wherein the bellows have a resiliency that returns the first and second members to their initial configuration when no pressure is applied to the bellows.

17. The coin acceptor of claim 9, further comprising a fourth member arranged below the first and second members for supporting the first and second members

18. A method for comparing an object, comprising:

spacing first and second members apart from one another in an initial configuration;

supporting a third member having the object selectively positioned thereon by said first and second members in said initial configuration with said third member being frictionally engaged by an upper surface of said first and second members;

preventing substantially horizontal movement of said third member;

moving said first and second members toward one another whereby the relative movement of each of the first and second members with respect to the third member corresponds to the weight of the object; and comparing the relative movement of the first and second members with a reference position.

19. The method of claim 18, wherein the first and second members are moved toward one another simultaneously.

20. The method of claim 18, wherein the first and second members are moved toward one another with equal force.

21. The method of claim 18, wherein said first and second members are moved horizontally toward one another by applying pressure to bellows adjacent each end of the first and second members.

22. The method of claim 18, further comprising the step of vending an article when said first and second members are displaced to a predetermined position relative to said reference position.

23. The method of claim 22, wherein said article is vended by releasing a latch.

24. The method of claim 18, further comprising the step of returning said first and second members to said initial configuration.

25. The method of claim 18, further comprising the step of removing the object from said third member after comparing the distance which the first and second members have been displaced with said reference position.

* * * * *